US007753620B2

(12) United States Patent
Kötting et al.

(10) Patent No.: US 7,753,620 B2
(45) Date of Patent: Jul. 13, 2010

(54) AUTOMOTIVE ROAD MILLING MACHINE, IN PARTICULAR LARGE MILLING MACHINE

(75) Inventors: Heinrich Kötting, Neustadt/Wied (DE); Christian Berning, Zülpich (DE); Martin Lenz, Grossmaischeid (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 12/155,850

(22) Filed: Jun. 11, 2008

(65) Prior Publication Data

US 2009/0010713 A1 Jan. 8, 2009

(30) Foreign Application Priority Data

Jul. 5, 2007 (DE) ..... 10 2007 033 808

(51) Int. Cl.
*E01C 23/16* (2006.01)
*E01C 23/07* (2006.01)
*E21C 25/00* (2006.01)

(52) U.S. Cl. ..... 404/94; 404/93; 404/84.5; 299/39.4

(58) Field of Classification Search ..... 404/84.2, 404/84.5, 93, 94; 299/39.1, 39.2, 39.3, 39.4; 296/190.01
See application file for complete search history.

(56) References Cited

U.S. PATENT DOCUMENTS 3,414,327 A 12/1968 Austin
3,694,033 A * 9/1972 Rowley et al. ..... 299/39.4
3,972,623 A * 8/1976 Funayama ..... 356/400

(Continued)

FOREIGN PATENT DOCUMENTS

DE 10347873 A1 5/2005

OTHER PUBLICATIONS

Exhibit A: Bomag Fayat Group Brochure (in German) dated Apr. 2007.

(Continued)

*Primary Examiner*—Thomas B Will
*Assistant Examiner*—Abigail A Risic
(74) *Attorney, Agent, or Firm*—Waddey & Patterson, P.C.; Lucian Wayne Beavers

(57) ABSTRACT

An automotive road milling machine, in particular large milling machine, for milling a ground surface or traffic surface, with a chassis provided with a front axle and a rear axle, consisting of crawler track units or wheels, a machine frame carried by the chassis with lateral outer walls and a longitudinal center-line, a milling drum supported at the machine frame between the crawler track units or wheels of the front axle and the rear axle, where one front end of the milling drum reaches as far as an outer side of the machine frame called the zero side for the purpose of close-to-edge milling, and an operator station with a platform for the machine operator, it is provided that the part of the machine frame located on the zero side in front of the platform of the machine operator when seen in the direction of travel is set back inwards in such a manner that a recess running in vertical direction and open towards the outer side, as well as towards the bottom and towards the top is formed in the machine frame, the said recess widening downwards and towards the front when seen in the direction of travel.

23 Claims, 3 Drawing Sheets

U.S. PATENT DOCUMENTS 4,139,318 A * 2/1979 Jakob et al. ..... 404/90
4,270,801 A * 6/1981 Swisher et al. ..... 299/1.5
4,456,829 A * 6/1984 Fohey ..... 250/559.23
4,516,808 A * 5/1985 Staab et al. ..... 299/39.4
4,543,578 A * 9/1985 Tomoyori et al. ..... 340/995.26
5,215,071 A * 6/1993 Mertes et al. ..... 125/13.01
5,546,123 A * 8/1996 Ikeda et al. ..... 348/119
5,564,408 A * 10/1996 Bassols ..... 125/12
5,695,255 A * 12/1997 LeBlond ..... 299/39.1
5,857,453 A * 1/1999 Caven et al. ..... 125/13.01
6,106,073 A * 8/2000 Simons et al. ..... 299/39.6
6,109,825 A * 8/2000 Yon ..... 404/84.05
6,203,112 B1 * 3/2001 Cook et al. ..... 299/39.3
6,210,071 B1 4/2001 McSharry
6,470,874 B1 * 10/2002 Mertes ..... 125/12
6,565,282 B1 * 5/2003 Gray ..... 404/94
6,619,882 B2 * 9/2003 Harvey ..... 404/107
6,997,641 B2 * 2/2006 Gaertner et al. ..... 404/93
7,331,636 B2 * 2/2008 Troudt et al. ..... 299/39.6
2001/0002229 A1 * 5/2001 Schaeffer et al. ..... 404/94
2005/0147467 A1 * 7/2005 Kieranen et al. ..... 404/84.1
2005/0207841 A1 * 9/2005 Holl et al. ..... 404/94

OTHER PUBLICATIONS

Exhibit B: Bomag Fayat Group Brochure (in English) dated Sep. 2007.

* cited by examiner

AUTOMOTIVE ROAD MILLING MACHINE, IN PARTICULAR LARGE MILLING MACHINE

BACKGROUND OF THE INVENTION

The invention relates to an automotive road milling machine, in particular a large milling machine.

Such road milling machines are, in principle, known already. For small milling machines, in which the milling drum is located at the level of the rear axle of the chassis and between the rear wheels, it is known to provide a recess in the lateral outer wall on the zero side of the machine that a rear support wheel or crawler track unit can swivel into.

Road milling machines with a milling width of more than 1200 mm, for instance, are called large milling machines. Such road milling machines have high weight and are therefore generally carried by a chassis with crawler track units. The milling drum is mounted at the machine frame between the crawler track units of the front axle and the rear axle, and at a distance to the same.

It is not customary to provide recesses in large milling machines, for large milling machines are not provided with swivelling rear wheels or swivelling rear crawler track units. Hence, there is no reason to provide a recess in the machine frame in large milling machines.

Because of, among other things, their limited maneuvrability, large milling machines have to date been used solely for working large surfaces, which enabled road corners with a large corner radius to also be worked in accordance with the course of the road.

Large milling machines pose the problem, in particular in case of milling operations that lead inward relative to the zero side, that the machine operator cannot precisely follow a pre-determined corner line with a tight corner radius, because the same is blocked from view by the machine frame. It is, however, difficult also to precisely follow a pre-determined corner line, irrespective of the direction it leads to, for the reason that the crawler track units are located underneath the machine frame and do not permit visual monitoring of the steering angle.

It is therefore the objective to create an automotive road milling machine, in particular large milling machine, that is usable in a more universal manner and the maneuvrability of which is improved.

SUMMARY OF THE INVENTION

The invention provides in an advantageous manner that, in a road milling machine in which the axis of the milling drum is preferably arranged between the front axle and the rear axle of the chassis and at a distance to the same, a recess is provided in the machine frame on the zero side in front of the platform of the operator station that widens downwards and towards the front when seen in the direction of travel.

The invention enables an improved maneuvrability for road milling machines in which the milling drum is arranged between the crawler track units or wheels of the front and rear axles, in particular when driving on the left, when the zero side is located on the right side of the machine in relation to the direction of travel. The recess widening downwards and towards the front when seen in the direction of travel makes it possible to not only follow a tight pre-determined corner radius inwards, but to also monitor the steering angle of the front chassis axle directly and independent of the direction of travel.

The recess widening downwards and towards the front when seen in the direction of travel offers the advantage that the construction volume of the machine in front of the operator station is reduced as little as possible. This is of importance for the reason that a water tank is usually accommodated in the front superstructure, so that the tank volume will be reduced as little as possible by the recess. The wall section of the recess running obliquely downwards and marking the boundary towards the front, for instance, is aligned in such a manner that the angle of vision of the sitting or standing machine operator is still capable of monitoring the steering position of the front crawler track unit or wheel.

The wall section marking the boundary of the recess thus follows the visual path of the machine operator. In this way, it is achieved that an improved visibility is created for the machine operator on the one hand, which leads to a better maneuvrability of the road milling machine, and that the tank volume. is not needlessly reduced on the other hand.

To date, road milling machines with a milling width of more than 1000 mm have barely been capable of carrying out tighter corner radii, so that such corner radii, as they frequently occur in, for instance, roundabout installations, needed to be worked with a different specialized road milling machine. The invention now enables the maneuvrability of road milling machines with a milling width of more than 1000 mm to be improved significantly, so that no different road milling machines need to be used for specific road construction operations. The invention is of particular advantage in road milling machines with milling widths ranging between 1000 and 2200 mm, preferably 1200 mm to 1500 mm, and expands their application possibilities.

According to a further development of the invention, it is provided in an advantageous manner that the seat of the machine operator above the milling drum, which is arranged between the axles when seen in the direction of travel and at a distance to the same, is aligned towards the lateral outer wall in such a manner that the seat of the machine operator partially projects laterally beyond at least the front part of the lateral outer wall.

The arrangement of the seat for the machine operator in such an outer position improves the view of the area in front of the milling drum and of the support wheel or crawler track unit of the front chassis axle on the zero side. The design of the recess enables a marking line, which runs inward starting from the zero side, to be followed for a very long distance, thus enabling the road milling machine to be steered very precisely along the said marking line. The maneuvrability is additionally facilitated by the fact that the steering position of the front chassis axle can be monitored simultaneously.

The seat of the machine operator may, with its vertical central plane running in the direction of travel, run in the plane of the lateral outer wall or at a small lateral distance essentially parallel next to the same.

The recess is provided with an inner wall section in the horizontal cross-section that runs essentially parallel to the direction of travel.

The inner wall section may alternatively run obliquely to the direction of travel, namely starting from the front edge and running obliquely to that point of the drum housing lying in the vertical plane of the front end of the milling drum on the zero side, or to the rear outer wall.

Adjoining the said inner wall section towards the front, the recess may be provided with at least one wall section running obliquely to a horizontal plane from the operator station and obliquely downwards in the direction of travel, meeting the plane of the lateral outer wall towards the zero side.

The adjoining wall section may also run obliquely towards the front with reference to a vertical plane running in the direction of travel.

A steering console with a steering wheel may be mounted laterally at the machine frame in front of the seat of the machine operator. The seat of the machine operator may be adjustable in height and/or movable in the operator station transversely to the direction of travel.

In an alternative embodiment, the rear chassis axle may be formed by one single support wheel or one single crawler track unit only.

The operator station is preferably arranged above the axis of the milling drum.

In a further development of the invention, it may be provided that a mirror is arranged in the area of the recess, permitting monitoring of a marking for the vertical plane of the zero-side front end of the milling drum, for instance, at the front side of the drum housing, also in the sitting position of the machine operator on the driver's seat. At the front side of the drum housing or at any other machine part within the recess which may, for instance, also be connected to the side plate, a marking consisting of, for instance, one or two vertical lines is applied close to the zero-side end of the drum housing, the said marking indicating the position of the zero-side front end of the milling drum. The mirror, which is adjustable manually or motorically, enables the machine operator when sitting in his seat on the operator station to monitor the said marking and/or the area of the ground surface or traffic surface in front of the drum housing.

At the same time, the recess is designed so that the front zero-side crawler track unit can still be seen also in the sitting position. The mirror can preferably be adjusted so as to enable the machine operator to monitor both the front edge of the drum housing, as well as the marking lines on the pavement surface when in the sitting position. The crawler track unit facing the zero side is directly visible also in the sitting position. According to a preferred further development, it is provided that the mirror, which is preferably arranged at the front wall section of the recess, cuts the vertical plane of the zero-side front end of the milling drum and is provided with markings, preferably marking lines, which can be matched via an alignment device with a pre-determined marking line on the ground surface or traffic surface.

The alignment device consists of linear devices running preferably parallel to the ground surface or traffic surface, in particular ropes or rods, that run in the vertical plane of the zero-side front end of the milling drum preferably between the outer wall sections, or enclose the said vertical plane between them.

The machine operator can check by means of the mirror and the alignment device as to whether the current steering position of the road milling machine is following the pre-determined marking line on the ground. To do so, he needs to reconcile the markings in the mirror with the marking line on the ground via the alignment device, and can then recognize as to whether the road milling machine is following the pre-determined milling track.

An additional further development of the road milling machine provides that a projection device projects a light marking onto the ground surface or traffic surface that is to be reconciled with the pre-determined marking line on the ground surface or traffic surface, the said light marking indicating the currently set further course of the milling edge at the zero-side front end of the milling drum in front of the drum housing when seen in the direction of travel in accordance with the position of the machine frame. This does not require an alignment device, as the marking on the ground surface or traffic surface and the light marking are located in one and the same plane. The markings on the ground surface or traffic surface can be compared to one another directly via the mirror in sitting or standing position.

A preferred embodiment of the further development consists in the light marking indicating the further course of the milling edge in accordance with the current steering angle of the travel drive unit. A computer calculates the course of the milling edge in accordance with the steering angles of the rear and front travel drive units and indicates the same on the ground surface or traffic surface via the projection device.

A sensor device can detect the position of the light marking in relation to the pre-determined marking line, in which case a control unit can regulate steering of the travel drive units automatically in accordance with the signals from the sensor device.

The projection device is preferably arranged at or below the driver's seat or the platform.

In the following, embodiments of the invention are explained in more detail with reference to the drawings.

DETAILED DESCRIPTION OF THE INVENTION

Figure 1:
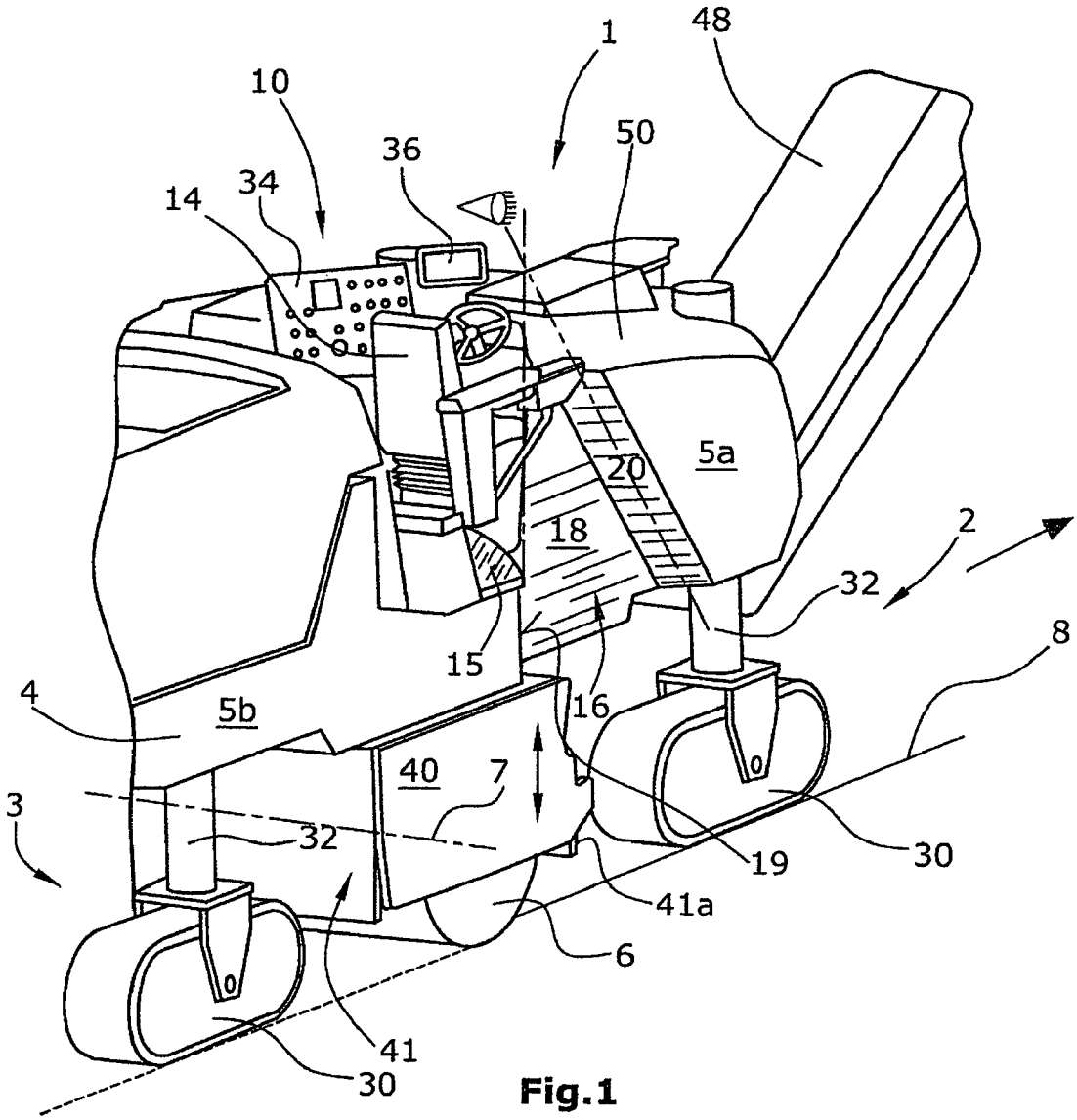
FIG. 1 a partial view of a large milling machine in accordance with the invention.

FIG. 1 shows a road milling machine 1, in particular a large milling machine with a machine frame 4 and a chassis with a steerable front axle 2, as well as with an equally steerable rear axle 3. The chassis is connected to the machine frame 4 via lifting columns 32 which enable adjustment of the distance of the machine frame 4 from a ground surface or traffic surface 8.

At the front end of the road construction machine, a transport conveyor 48 capable of slewing in both height and lateral direction is arranged for the removal of the milled material.

The front axle 2 and the rear axle 3 of the chassis may consist of two crawler track units 30 and/or two wheels each.

The machine frame 4 is provided with lateral outer walls 5*a*, 5*b* that run essentially vertically and parallel to the longitudinal centre-line of the road milling machine 1. It is understood that the outer walls need not run strictly vertical and absolutely parallel to the longitudinal centre-line of the road milling machine 1, but that slight deviations are possible. The outer wall is preferably manufactured from one single part, with the outer wall sections 5*a*, 5*b* being preferably located in one and the same plane.

A milling drum 6 with a milling drum axis 7 supported at the machine frame 4 for milling the ground surface or traffic surface 8 is arranged between the crawler track units 30. With its one front end, the milling drum 6 reaches as far as the outer side of the machine frame 4 called the zero side 12, while a driving device for the milling drum 6 is arranged at the opposite outer wall of the machine frame 4.

A height-adjustable side plate 40 serving as edge protection is arranged at the front end of the milling drum 6 facing the zero side 12 and next to the drum housing 41.

The milling drum 6 is arranged preferably centrally between the front axle 2 and the rear axle 3.

The operator station 10 with a seat 14 for the machine operator arranged on the zero side 12 is located above the milling drum 6.

The seat 14 is preferably aligned towards the lateral outer wall 5*a*, 5*b* in such a manner that the seat 14 projects laterally at least partially vis-à-vis the outer wall 5*a*, 5*b*; this applies in particular relative to the front outer wall 5*a* in the event that the same should not run in one and the same plane with the rear outer wall 5*b*.

The seat 14 is height-adjustable and is additionally movable in a sliding manner transversely to the direction of travel. The seat 14 may, with its vertical central plane running in the direction of travel, run in the plane of the lateral outer wall 5*a*, 5*b* or at a small lateral distance parallel next to the same.

When the road milling machine is moved along an obstacle, such as a mast, with the zero side, the seat 14 with the armrest 42 and the operating panel 44 can be moved inwards in a sliding manner so as to allow milling along the obstacle in as flush a manner as possible.

A control panel 34 and a device 36 for setting the operating parameters are provided next to the driver's seat in the direction of the machine centre.

A steering console 24 is mounted laterally at the machine frame 4 to rotate around a horizontal axis so as to enable adjustment of the position of a steering wheel 26. The operator station 10 is provided with a platform 15 as standing surface for the machine operator, the said platform 15 being slanted towards the zero side and towards the rear to improve the view of the drum housing 41 in front of the milling drum 6, in particular of the front side 41*a* of the drum housing 41 surrounding the milling drum 6, on the zero side.

At the front side 41*a*, the drum housing 41 may be provided with a marking of, for instance, one or two vertical lines that indicates to the machine operator the position of the front edge of the milling drum 6 on the zero side.

Figure 2:
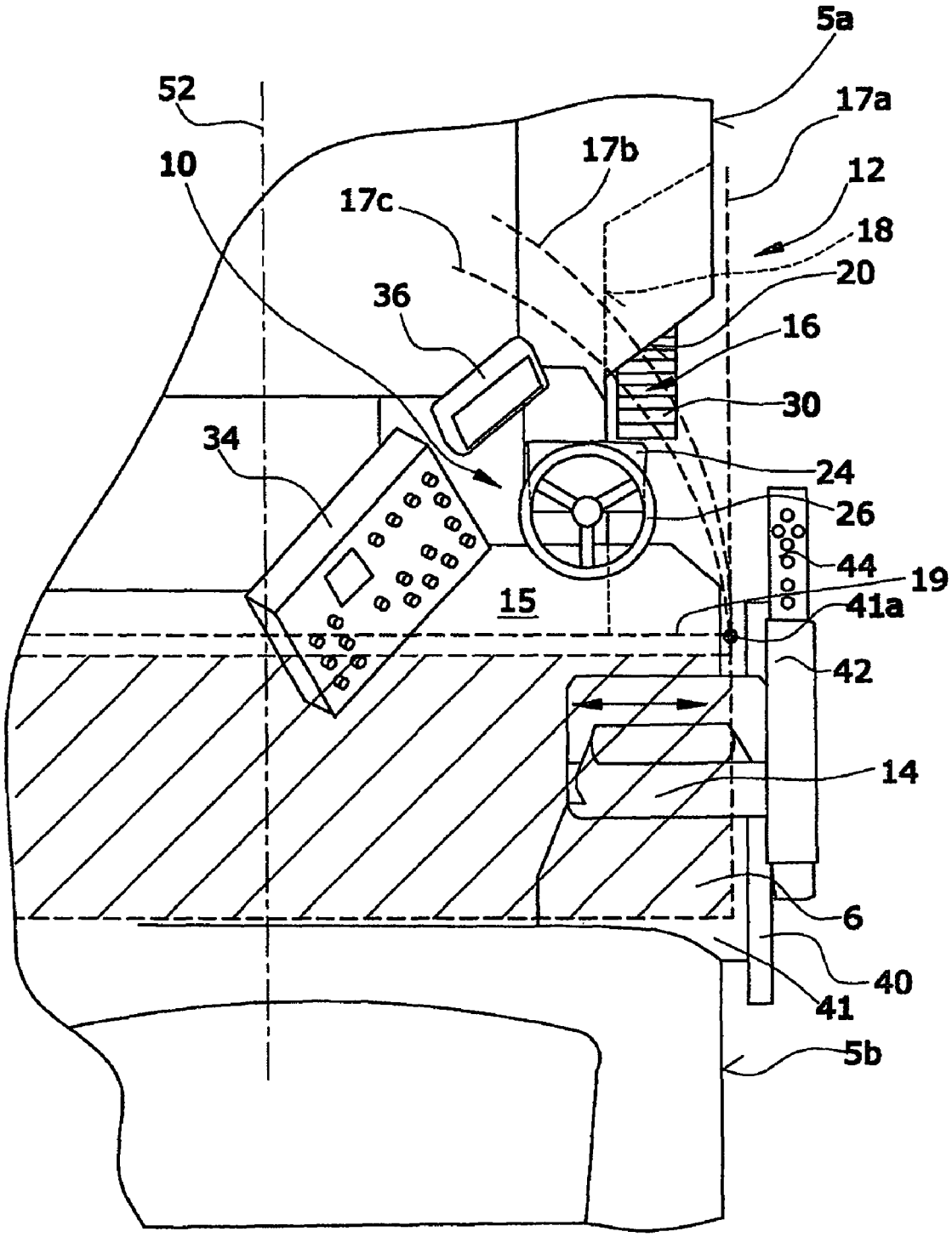
FIG. 2 a top view of the operator station of the large milling machine.

In FIG. 2, the engagement area of the milling drum 6 at a specific milling depth is exemplified by the hatched area.

As can best be seen from FIG. 1, the machine frame 5 is provided with a recess 16 at the level of the front outer wall 5*a*, where wall sections 18 and 20 mark the boundary of the said recess 16 towards the interior of the road milling machine, as well as towards the front. The angle of vision that the machine operator has from his operator station 10 is drawn in FIG. 1.

The wall section 20 runs at an angle towards the front when seen in the direction of travel and meets the outer wall 5*a*.

The recess 16 enables monitoring of the front right crawler track unit and thus monitoring of the current steering angle. The angle of inclination, as measured from above, of the wall section 20 to a vertical plane running transversely to the direction of travel may be, for instance, between 20° and 50°, preferably 30° to 40°.

The inner wall section 18 runs essentially parallel to the longitudinal centre-line of the road milling machine. The wall section 18 is preferably vertical but may also be inclined from the vertical plane inwards by, for instance, up to 20° in the direction of the ground surface or traffic surface 8. The wall section 20 adjoining the wall section 18 towards the front may additionally run obliquely with reference to the outer wall 5*a* at, for instance, an angle of 120°±70°, preferably 120°±10°, towards the front.

A wall section 19 furthermore marks the boundary of the recess 16 towards the rear, the said wall section 19 extending essentially vertically from the platform 15 of the operator station 10 downwards to the drum housing 41.

The wall section 19 may be omitted if the wall section 18, starting from its front edge, does not run parallel to the direction of travel but runs obliquely in the direction of the marking at the front edge 41*a* of the drum housing 41. According to a further alternative, the wall section 18 may also meet the rear outer wall 5*b* in the area of the drum housing 41.

The lines 17*a*, 17*b*, 17*c* represent markings on the ground surface or traffic surface 8, which reflect the desired course of the road. The marking 17*a* indicates a straight-ahead travel, and the marking lines 17*b* and 17*c* indicate different corner radii when steering the road milling machine 1 towards the left or inwards respectively. It can be seen from FIG. 2 that, owing to the recess 16, the marking lines 17*b* and 17*c* can be monitored by the machine operator on the operator station 10 to a much greater extent than if the recess 16 did not exist and the machine frame 4 at the outer wall 5*a* without the recess 16 reached as far as the platform 15. It is understood that, when travelling through a corner along the marking lines 17*b* or 17*c*, the crawler track unit 30 is swivelled so as to not block the marking lines 17*b* or 17*c* respectively from view. The recess 16 furthermore enables monitoring of the steering angle of the front crawler track unit 30 so as to enable the road milling machine to be steered precisely in accordance with the pre-determined course of the road, with the machine operator guiding, for instance, the marking at the front side 41*a* of the drum housing 41 along the marking lines 17*a*, 17*b* or 17*c*.

The special design of the recess 16 not only allows an improved possibility of tracking the marking lines 17*b* or 17*c* while simultaneously monitoring the steering angle of the front axle, but simultaneously ensures that the volume of the tank 50 located above the front axle is not needlessly reduced.

As can again best be seen from FIG. 1, the tank volume of the tank 50 is reduced only slightly by the recess 16, in particular because of the obliquely running wall 20.

It is understood that the recess 16 may be arranged in a corresponding manner also on that side of the machine facing away from the zero side 12, in addition to the recess 16 provided on the zero side 12. The design of the said additional recess 16 may be mirror-symmetrical to the recess 16 on the zero side, namely with reference to a longitudinal centre-line 52 of the road milling machine 1.

Figure 3:
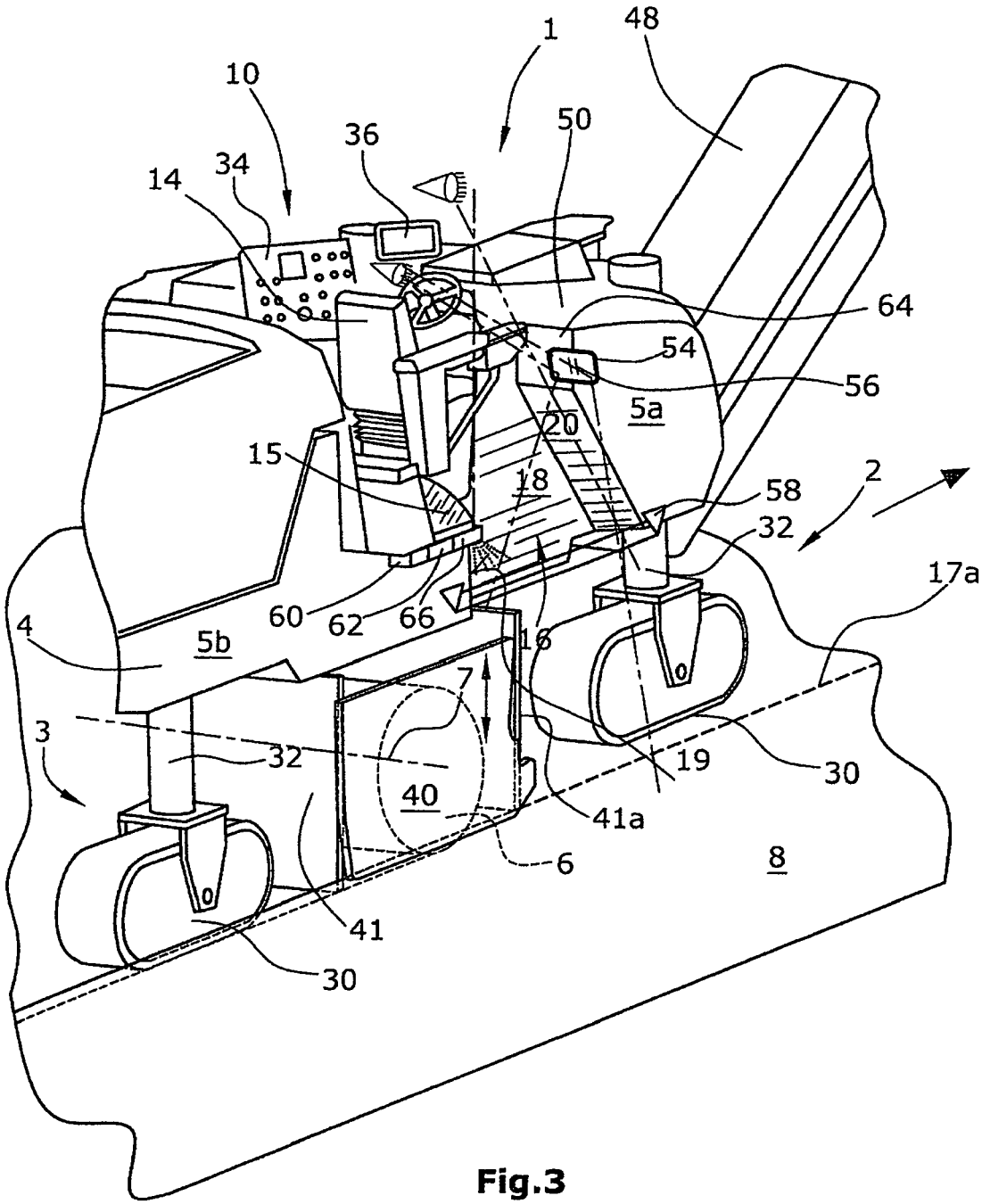
FIG. 3 an embodiment with an alignment device and/or projection device.

FIG. 3 shows an embodiment of a road milling machine 1, which may be provided with a mirror 54, an alignment device 58 and/or a projection device 62.

The mirror 54, which may, for instance, be arranged at an essentially vertical surface 64 in the area of the recess 16, is adjustable manually or motorically and may also consist of a curved mirror. The arrangement of the mirror is such that it projects beyond the plane of the front end of the milling drum 6 in the direction of the zero side.

FIG. 3 schematically depicts the eye of the machine operator when sitting on the driver's seat 14. The machine operator's angle of vision then registers a wide area in front of the drum housing 41 when seen in the direction of travel by means of the mirror 54, where the machine operator is capable of monitoring in particular the marking at the front side 41*a* of the drum housing 41 or at any other machine element that indicates the vertical plane of the front end of the milling drum 6. The machine operator is also capable of monitoring the current marking lines 17*a*, 17*b* or 17*c* on the ground surface or traffic surface 8 by means of the mirror 54, which may also be of curved design. For the purpose of better alignment, the mirror 54 may be provided with markings 56, for instance, a line that runs in the plane of the front end of the milling drum 6, or two lines at a parallel distance to one another that run parallel to one another and accommodate the vertical plane of the front end of the milling drum 6 between them, which the machine operator needs to match for alignment with an alignment device 58 and with one of the marking lines 17*a,* 17*b* or 17*c* on the ground surface or traffic surface 8.

The alignment device 58 may consist, for instance, of two ropes tensioned between the outer wall sections 5*a,* 5*b,* the said ropes running parallel to one another and accommodating the vertical plane of the front end of the milling drum 6 between them.

The alignment device 58 may alternatively also consist of one single rope that runs in the plane of the front end of the milling drum 6. In combination with the alignment device 58, the mirror 54 therefore permits maneuvering of the road milling machine 1 from a sitting position.

Independent of the mirror 54 and the alignment device 58, a projection device 62 may also be provided that emits a beam of light focused on the ground surface or traffic surface 8, the said beam of light indicating the course of the zero-side milling edge in the form of a series of dots or a line preferably in accordance with the current steering position. The projection device 62 thus works in the manner of a laser pointer which generates a series of dots or a line. The beam of light may be a beam of laser light.

A computer 60 calculates the course of the milling edge in front of the drum housing 41 when seen in the direction of travel and controls the laser projection device 62 accordingly. The calculation is effected in accordance with the steering angle of the front and/or rear chassis axle. It is understood that the travel drive units may also be steered in opposite directions to follow a specific pre-determined corner shape as pre-determined by the marking lines 17*a,* 17*b* or 17*c* on the ground surface or traffic surface 8. By comparing the projected line of laser light and the applied marking lines 17*a,* 17*b* and 17*c,* the machine operator can determine as to whether the current steering angle is following the desired corner shape.

A further development of the said light projection device consists in that a sensor device determines the difference between the projected line and the pre-determined marking line 17*a,* 17*b* or 17*c,* where steering of the road milling machine 1 is regulated automatically by means of a control unit 66.

Although a preferred embodiment of the invention has been specifically illustrated and described herein, it is to be understood that minor variations may be made in the apparatus without departing from the spirit and scope of the invention, as defined by the appended claims.

What is claimed is:

1. Automotive road milling machine of the large-sized type, for milling a ground surface or traffic surface, with a chassis provided with a front axle and a rear axle, including one or more crawler track units or wheels, a machine frame carried by the chassis with lateral outer walls and a longitudinal center-line, a milling drum supported at the machine frame, the milling drum being located at a distance ahead of the crawler track units or wheels of the rear axle and at a distance behind the crawler track units or wheels of the front axle, where one front end of the milling drum reaches as far as an outer side of the machine frame called the zero side for the purpose of close-to-edge milling, and an operator station with a platform for the machine operator, characterized in that the part of the machine frame located on the zero side in front of the platform for the machine operator when seen in the direction of travel is set back inwards in such a manner that a recess running in vertical direction and open towards the outer side, as well as towards the bottom and towards the top is formed in the machine frame, the said recess widening in such a manner downwards and towards the front when seen in the direction of travel that a steering angle of at least one of the front crawler track units or wheels is visible to the operator from the platform.

2. Road milling machine in accordance with claim 1, characterized in that the operator station is provided with a seat for the machine operator, and that the seat of the machine operator above the milling drum, which is arranged between the axles when seen in the direction of travel and at a distance to the same such that the seat is located a distance in front of the rear axle and a distance behind the front axle, is aligned towards the lateral outer wall in such a manner that the seat of the machine operator partially projects laterally beyond at least a front part of the lateral outer wall.

3. Road milling machine in accordance with claim 2, characterized in that the seat of the machine operator, with the vertical central plane of the seat running in the direction of travel, runs in the plane of the lateral outer wall or at a small lateral distance parallel next to the same.

4. Road milling machine in accordance with claim 1, characterized in that the recess is provided with an inner wall section in the horizontal cross-section that runs essentially parallel to the direction of travel.

5. Road milling machine in accordance with claim 4, characterized in that the recess is provided with at least one adjoining wall section running obliquely downwards from the operator station when seen in the direction of travel, which meets the plane of the lateral outer wall in the direction of the zero side.

6. Road milling machine in accordance with claim 5, characterized in that the adjoining wall section runs obliquely towards the front also with reference to a vertical plane running in the direction of travel.

7. Road milling machine in accordance with claim 2, characterized in that a steering console with a steering wheel is mounted laterally at the machine frame in front of the seat of the machine operator.

8. Road milling machine in accordance with claim 1, characterized in that the rear chassis axle is formed by one single support wheel or one single crawler track unit only.

9. Road milling machine in accordance with claim 1, characterized in that the operator station is arranged at a distance from the chassis axles above the axis of the milling drum.

10. Road milling machine in accordance with claim 1, characterized in that the outer wall on the outer side facing away from the zero side is provided with a recess corresponding to the recess in an essentially mirror-symmetrical manner relative to the longitudinal center-line.

11. Road milling machine in accordance with claim 1, characterized in that the outer wall on the outer side facing away from the zero side is provided with a recess corresponding to the recess that is open towards the outer side, as well as towards the bottom and towards the top.

12. Automotive road milling machine for milling a ground surface or traffic surface, with a chassis provided with a front axle and a rear axle, including crawler track units or wheels, a machine frame carried by the chassis with lateral outer walls and a longitudinal center-line, a milling drum supported at the machine frame, with one front end of the milling drum reaching as far as an outer side of the machine frame called the zero side for the purpose of close-to-edge milling, and an operator station with a platform for the machine operator, characterized in that the part of the machine frame located on the zero side in front of the platform for the machine operator when seen in the direction of travel is set back inwards in such a manner that a recess running in vertical direction and open towards the outer side, as well as towards the bottom and towards the top is formed in the machine frame, where a mirror is arranged in the area of the recess that permits monitoring of a marking for the vertical plane of the zero-side front end of the milling drum also in the sitting position of the machine operator on the driver's seat.

13. Road milling machine in accordance with claim 2, characterized in that a mirror is arranged in the area of the recess that permits monitoring of a marking for the vertical plane of the zero-side front end of the milling drum also in the sitting position of the machine operator on the driver's seat.

14. Road milling machine in accordance with claim 12, characterized in that the mirror is adjustable in such a manner that the machine operator can, when in the sitting position, monitor both the marking for the vertical plane of the zero-side front end of the milling drum as well as a pre-determined marking line on the ground surface or traffic surface.

15. Road milling machine in accordance with claim 12, characterized in that the mirror cuts the vertical plane of the zero-side front end of the milling drum and is provided with marking lines which can be matched with a pre-determined marking line on the ground surface or traffic surface via an alignment device.

16. Road milling machine in accordance with claim 15, characterized in that the alignment device includes one or more linear devices running parallel to the ground surface or traffic surface in the vertical plane of the zero-side front end of the milling drum between the outer wall sections.

17. Road milling machine in accordance with claim 1, characterized in that a projection device projects a light marking onto the ground surface or traffic surface that is to be reconciled with a pre-determined, marking line on the ground surface or traffic surface, the said light marking indicating the currently set future course of the milling edge in a linear manner at the zero-side front end of the milling drum in front of a drum housing when seen in the direction of travel.

18. Road milling machine in accordance with claim 1, characterized in that a projection device projects a light marking onto the ground surface or traffic surface that is to be reconciled with one of the pre-determined marking lines on the ground surface or traffic surface, the said light marking indicating the currently set future course of the milling edge at the zero-side front end of the milling drum in front of the a drum housing when seen in the direction of travel in accordance with the current steering angle of the front crawler track units or wheels.

19. Road milling machine in accordance with claim 18, characterized in that a computer calculates the future course of the milling edge in accordance with the steering angles of the rear and front wheel units or crawler track units and indicates the same on the ground surface or traffic surface via the projection device.

20. Road milling machine in accordance with claim 18, characterized in that a sensor device detects the position of the light marking in relation to one of the pre-determined marking lines, and that a control unit regulates steering of the crawler track units or wheels automatically in accordance with the signals from the sensor device.

21. Road milling machine in accordance with claim 18, characterized in that the projection device is arranged at or below the platform.

22. Road milling machine in accordance with claim 13, characterized in that the mirror is adjustable in such a manner that the machine operator can, when in the sitting position, monitor both a front edge of the milling drum, as well as a pre-determined marking line on the ground surface or traffic surface.

23. Road milling machine in accordance with claim 19, characterized in that a sensor device detects the position of the light marking in relation to one of the pre-determined marking lines, and that a control unit regulates steering of the crawler track units or wheels automatically in accordance with the signals from the sensor device.

* * * * *